United States Patent [19]

Wenger

[11] Patent Number: 4,477,984

[45] Date of Patent: Oct. 23, 1984

[54] MULTI PURPOSE THREE PASS DRUM DRYER

[75] Inventor: Harvey Wenger, Holland, Mich.

[73] Assignee: Wilfred O. Schmidt, Grand Rapids, Mich. ; a part interest

[21] Appl. No.: 202,113

[22] Filed: Oct. 30, 1980

[51] Int. Cl.[3] ..... F26B 17/32

[52] U.S. Cl. ..... 34/128; 34/137; 34/141; 432/107; 432/114

[58] Field of Search ..... 432/105, 107, 111, 112, 432/114; 34/128, 129, 134, 135, 136, 137, 138, 140, 141, 142

[56] References Cited

U.S. PATENT DOCUMENTS

| | | | |
|---|---|---|---|
| 1,358,313 | 11/1920 | Hero | 34/128 |
| 2,618,865 | 11/1952 | Arnold | 34/128 |
| 2,752,130 | 6/1956 | French | 34/128 |

*Primary Examiner*—Larry I. Schwartz

*Attorney, Agent, or Firm*—Wilfred O. Schmidt

[57] ABSTRACT

A multi purpose three pass drum dryer comprised of two independent and intermeshed systems utilizing an air circulation flowing contrary to the progression of the material through the dryer.

7 Claims, 5 Drawing Figures

SECTION B–B

SECTION C–C

MULTI PURPOSE THREE PASS DRUM DRYER

Figure 1:
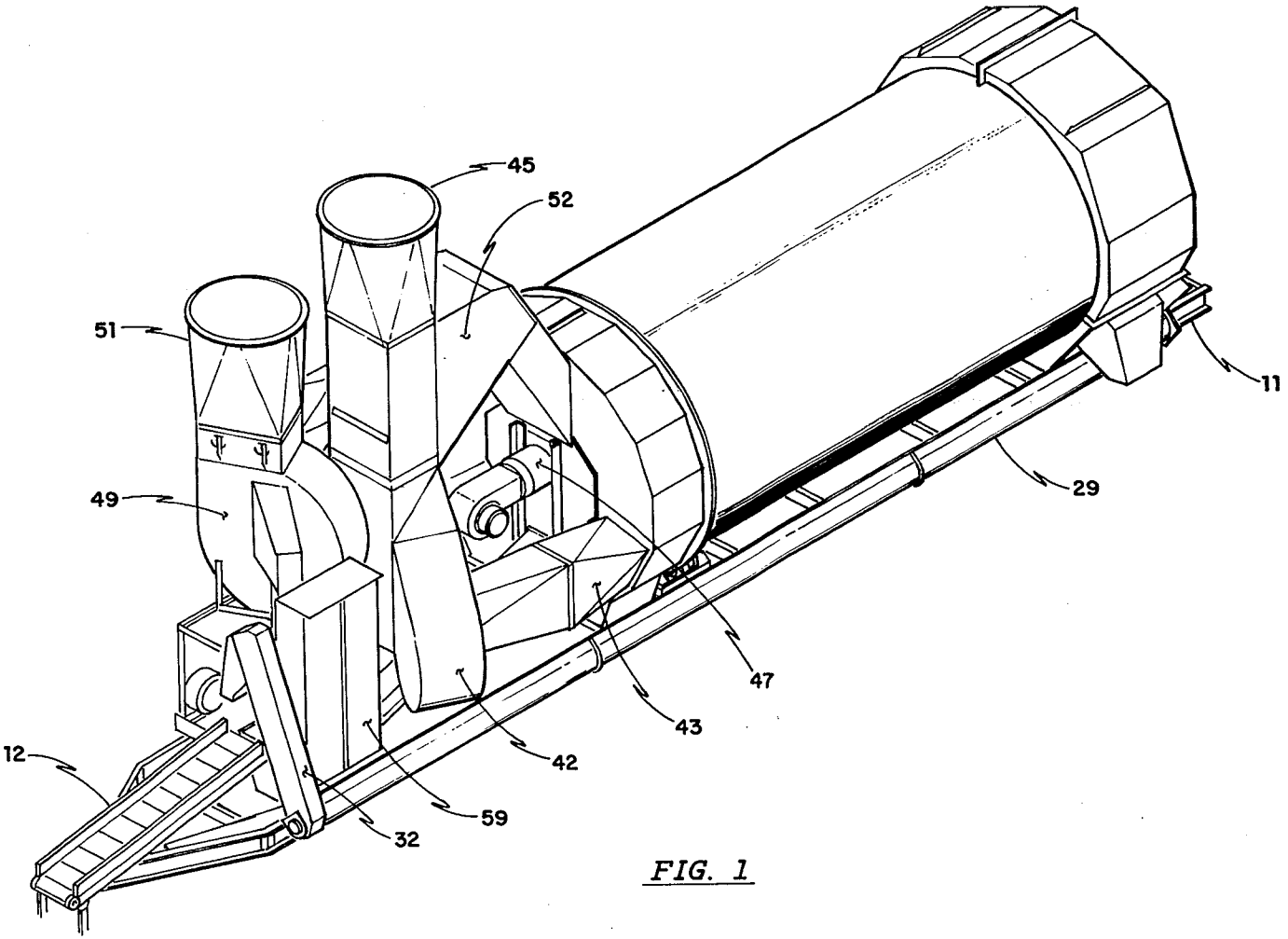

The Dryer is a rotary drum, multi-pass, indirect fired dryer comprised of two independent and intermeshed systems, i.e., a two pass heat-exchange system and a three pass drying system to convert a moisture laden product into a dried granular one.

Bulk material dryers have been used for conditioning organic wastes for use as fertilizer. The bulk dryers have been used in conjunction with sewage plants and also large scale cattle or poultry operations with the result that the disposal problem became a source of revenue. Also, drying has been successfully applied in the dehydration of a wide range of feeds, foods and fibers.

Heretofore steam heated rotary dryers, whether single or multiple pass, set on an incline or in a horizontal position, have been used wherein the material and the air flow in the same direction. In this type of dryer the moisture is separated from the material outside the dryer by a cyclone which also acts as a cooling medium for the product.

It is the object of the present invention to provide a method and apparatus for drying or dehydrating bulk material utilizing a multi-pass rotary dryer wherein the air flows counter to the direction of travel of the material. It is also the object of the invention to provide a method and apparatus for drying or dehydrating bulk material utilizing a multi-pass dryer wherein the counter flowing air flow separates the moisture from the material within the said dryer. It is also the object of this invention to provide a method and apparatus for drying or dehydrating bulk material utilizing a multi-pass dryer wherein the counter air flow at minimum temperature and minimum moisture content encounters the material at maximum temperature and minimum moisture content during the last pass through the dryer and separates the last vestige of moisture from the material, entrains the dust particles given off in the drying process, and cools the material to a handling temperature prior to discharge.

It is also the object of this invention to provide a method and apparatus for drying or dehydrating a bulk material utilizing a multi-pass dryer wherein the heat content of the air flowing in the second and first pass, in that order, increases rapidly to absorb the moisture evaporated from the counter progressing material without case hardening the particles of material.

It is the further object of this invention to provide a method and apparatus for drying or dehydrating bulk material by utilizing a multi-pass dryer wherein the air circulated in a direction counter to the progress of the material dried is heated to a maximum temperature in order to effect a maximum absorption of moisture, odor, vapors and dust and is after burned to insure a clean and odor free drying operation.

The dryer of this invention is of rotary drum construction, consisting of five (5) concentric cylinders mechanically interlocked for unison rotation. The innermost cylinder defines the central combustion chamber. The other four (4) cylinders define ducts of hollow circular cross section, concentric about the central combustion chamber. The concentric ducts, identified outward of the central combustion chamber, are the inner-duct, the intermediate-duct, the heat-exchange-duct and the outer-duct.

The central combustion chamber and the third tiered heat-exchange-duct comprise a two pass heat-exchange-system. The system has a separate stack to vent the combustion products into the atmosphere.

The inner-, intermediate- and outer-ducts comprise the three pass drying system. Each duct represents a one dryer length pass of the material at a fixed radial displacement from the central combustion chamber.

The three pass drying system is intermeshed by the two pass heat-exchange-system and the former connects to the latter only for purposes of after burning. Consequently, the three pass drying system is heated indirectly by the two pass heat-exchange-system thereby avoiding direct exposure of the material to heat and flame and possible carbonization and destruction of the material, as well as, darkening and impairing the material's quality.

The heat for the heat-exchange-system is furnished by a natural gas or oil pressure type burner which fires into the central combustion chamber. The resultant heat and combustion products radiate and travel the length of the said chamber and upon impinging on the end plate are deflected radially outward and thereafter are mechanically drawn back the length of the dryer through the heat-exchange-duct. After traveling the length of the heat-exchange-duct, the combustion by-products are vented through a stack into the atmosphere.

The means for moving the material laterally through the three pass drying system are the "lifters" and "deflectors" attached to the upper inner wall of each duct.

The "lifters" extend longitudinally of the duct and are symmetrically disposed about the periphery. The "deflectors" are helical flighting and connect the "lifters" to each other. As the ducts are rotated the material contained is repeatedly carried to the top by the "lifters" and then tumbled down upon the "deflectors". As the consequence, the material is slid in the direction pre-determined by the angular displacement of the "deflectors". The "deflectors" of the inner-duct and those of the outer-duct are disposed to slide the product toward the aft end of the dryer, whereas the "deflectors" in the intermediate-duct are disposed to slide the product in the opposite direction. Thus, the product is tumbled and fragmentized as it is slid back or forth the length of the respective ducts and is displaced radially in progressing from one duct to another, i.e., radially outward from inner- to intermediate-duct from the intermediate- to outer-duct and from the outer-duct to discharge.

The air to remove the moisture evaporated from the material as it dries is drawn into the dryer from the aft or discharge end of the dryer, specifically, at the extreme aft end and peripherally of the outer duct. The air flows through the three concentric duct passageways in a direction counter to material progress and aerates the material as it is tumbled and fragmentized by the combined operation of the "lifters", "deflectors" and duct rotation. As the result, the air entering the dryer will be at a minimum temperature and minimum moisture content when flowing in the outer-duct. However, the air flowing through the intermediate- and inner-ducts will be exposed to a uniformly high temperature and will rapidly accelerate in heat content with an accompanying acceleration in moisture absorption.

To insure a clean and odor free drying operation, the moisture, odor and dust laden air can be selectively released to the outside environment by way of an after burner, that is by circulation through the heat-exchange-system. As the consequence, the contaminates carried by the released air are burned off prior to exhausting to the atmosphere.

Consequently, the dryer by design utilizes a two pass heat-exchange-system contained in a closed circuit. Also, it was designed so that the maximum drying rate is effected during the progress of the material through the inner and intermediate- ducts where a uniformly high temperature can be maintained and where the product has the highest moisture content. The minimum rate of drying (relatively a cooling rate) is effected on the progress of the material through the outer-duct which ends with the discharge of the dried granular material from the dryer. As the result of the lower drying rate in the outer-duct, the dried granular material discharged is at a relatively low temperature to permit direct handling.

Referring to the drawings

FIG. 1 An isometric view of the dryer

Figure 2:
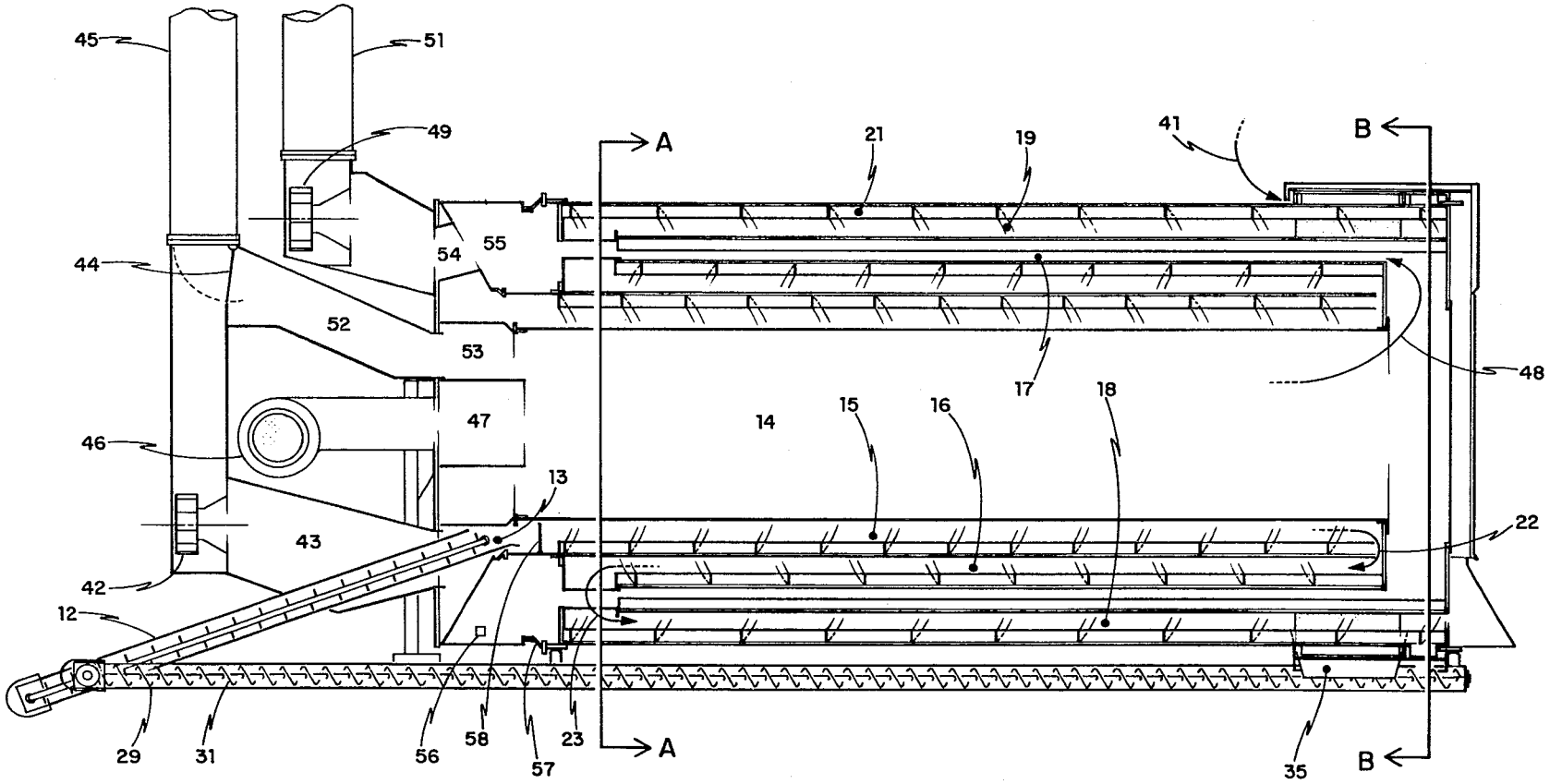

FIG. 2 A vertical section taken through the dryer

Figure 3:
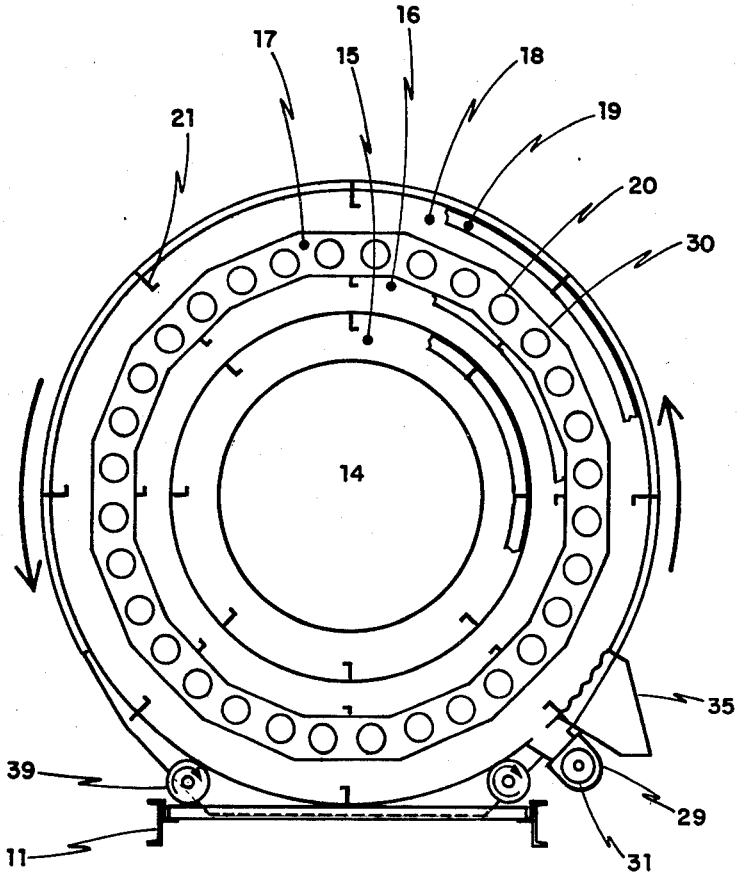

FIG. 3 A cross sectional view taken along line A—A on FIG. 2

Figure 4:
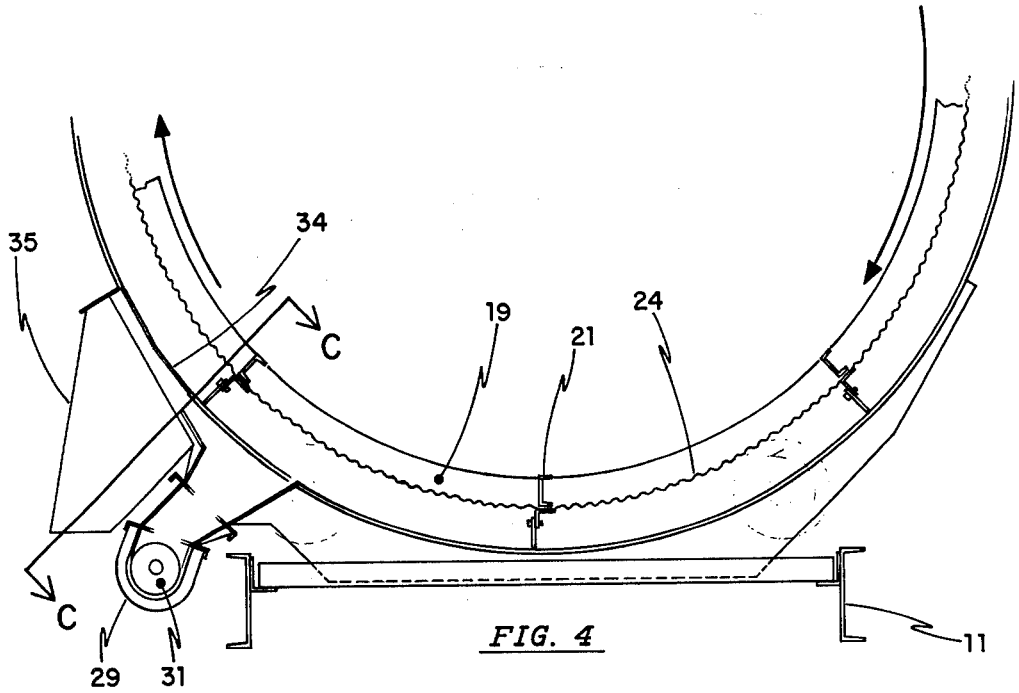

FIG. 4 A cross sectional view taken along line B—B on FIG. 2

Figure 5:
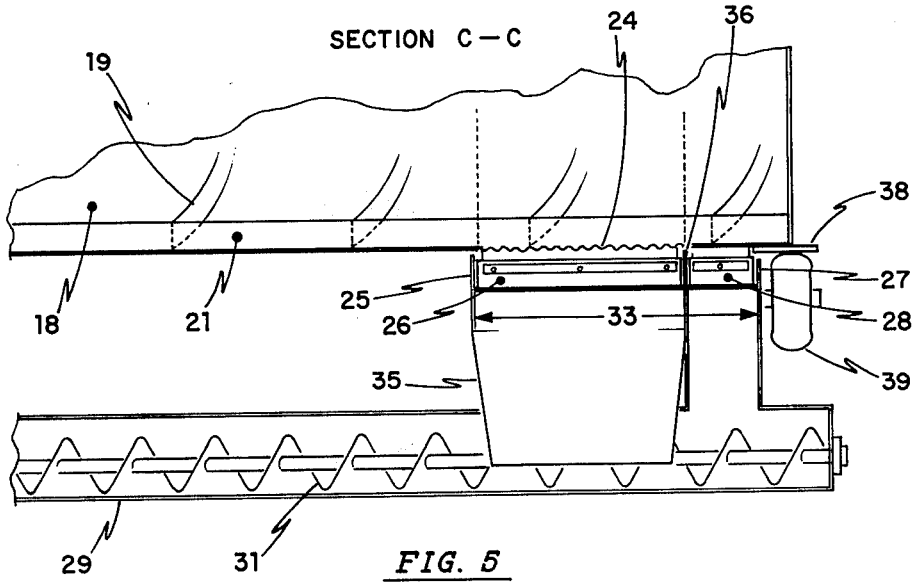

FIG. 5 A cross sectional view taken along line C—C on FIG. 3

The dryer is supported on frame 11. A conveyor 12 delivers material to be dried to the dryer intake 13 at the input end of the inner-duct 15.

The inner-duct 15 has "lifters" 21 (See FIG. 3) equally spaced about the inner periphery of the outer wall which in turn are connected by the "deflectors" 19. The "deflectors" 19 are of a helical flighting configuration and connect the "lifters" 21. As the inner-duct 15 and all ducts are rotated clockwise, looking from aft to fore, the material lodged in the "lifters" 21 is raised to the top of the said duct and thereafter drops upon the "deflectors" 19 and is slid in the direction determined by the helix flighting.

After progressing the length of the inner-duct 15, the material is dropped through the aft duct junction 22 into the intermediate-duct 16. By means of "lifters" 21 and "deflectors" 19 attached to the intermediate-duct 16 and as the consequence of the same clockwise rotation, the material moves the length of the said intermediate-duct 16 but in the reverse direction. The new or reverse direction of material movement is caused by the angular displacement of the helix flighting of the "deflectors" 19 which are 180° out of phase with the angular displacement of the helix flighting of the inner-duct 15. Again, after progressing the length of the intermediate-duct 16, the material is dropped through the fore duct junction 23 into the outer-duct 18. The material now progresses in the same direction as was the case in the inner-duct 15, that is the clockwise rotation and the angular displacement of the helix flighting, which is in phase with the angular displacement of the helix flighting in the inner-duct 15.

The fore duct junction 23 differs from the aft duct junction 22 in that the transfer of material must be made across an intervening duct, the heat-exchange-duct 17. To accomplish this transfer without disrupting the separate communication of the heat-exchange-system and the drying system, an adaptor platen 30 encloses the heat-exchange-duct 17. The adaptor platen 30 has heat exchange tubes 20 of given length and diameter permanently fixed therein to individually bridge the distance between the heat-exchange-duct 17 and the manifold 55. The individual bridging assures a closed heat-exchange-system and yet permits the material to drop between the said individual bridge from the intermediate-duct 16 to the outer-duct 18.

At the output end of the outer-duct 18 the material is exited over a screen 24 through which particles of predetermined size drop into a receiving tray 25. Thereafter a flexible peddler 27 pushes the material from the said receiving tray 25 through the discharge spout 35. From the discharge spout 35 the material can be conveyed to a storage bin or bagger.

The larger particle sizes are exited into a second receiving tray 27. The oversized particles are then pushed by the flexible peddler 28 into the passage leading to the recycle auger assemble 29.

Simultaneously with the rotation of the dryer and the movement of the material in the inner-duct 15 are the operations to induce a counter air circulation and to induce heat transfer from the heat-exchange-system; both are dependent upon blowers 42 and 49 respectively.

The counter flowing airstream is pulled into the dryer by blower 42. The airstream enters through the screen enclosure 41 situated about the periphery of the aft end of the outer duct 18. The airstream is forced to flow from the terminal end of the outer-duct 18 toward its input end. After spilling into the fore duct junction 23, the airstream is then forced to flow from the terminal end to the input end of the intermediate-duct 16. Again, after spilling into the aft duct junction 22, the airstream is forced to flow from the terminal end to the input end of the inner-duct 15. Thereafter the airstream is pulled from the dryer by way of the dryer intake 13 and pushed through the exhaust stack 45 whenever the damper 44 is in the open position or in the alternative is pushed to circulate through the heat-exchange-system before exhausting to the atmosphere if the damper 44 is in the closed position.

The airstream aerates the material encountered in each of the respective ducts, particularly as the material is tumbled and fragmentized by the "lifters" 21 and the "deflectors" 19 as the consequence of the aforementioned clockwise rotation.

The heat-exchange-system indirectly heats both the material to evaporate the moisture therefrom, as well as, indirectly heating the air to increase its moisture absorption capability.

The burner 47 in conjunction with burner blower 46 fires into the central combustion chamber 14. The heat transfer and combustion products are pulled from chamber 14 through the heat exchange junction 48 and through the heat-exchange-duct 17 and thereafter vented into the atmosphere through stack 51.

The central combustion chamber 14 is enveloped by the inner-duct 15, which in turn is enveloped by the intermediate-duct 16. The heat-exchange-duct 17 envelopes the intermediate-duct 16 and is interjacent with the outer-duct 18. Consequently a closed radial heat transfer path is established between the central combustion chamber 14 and the heat-exchange-duct 17 to maintain a uniformly high temperature across both the sandwiched inner- and intermediate-ducts 15 and 16. The outer-duct 18 receives substantially less heat; that is, that limited to the heat convected and radiated by the heat exchange-duct-alone.

As the consequence, the material progressing through the inner-duct and intermediate-duct 15 and 16, which are both exposed to a substantially same uniformly high temperature and is heated to a maximum accompanied by a high rate of moisture evaporation. When the material leaves the aforementioned ducts 15 and 16 and progresses through the outer-duct 18, it is exposed to relatively lower temperature thereby dissipating a certain amount of its heat content and the rate of evaporation previously attained or relatively cooling the material.

The airstream flowing in the outer-duct 18 is at an ambient temperature and by aerating tends to cool the material encountered. Additionally, the reverse flowing airstream entrains dust particles released during the drying process and carries them back into the dryer. Upon flowing through the intermediate- and inner-ducts 16 and 15 the airstream is, as aforementioned, exposed to substantially the same uniformly high temperature. The airstream is heated thereby and attains maximum moisture absorption capability. Consequently, as maximum evaporation and maximum moisture absorption takes place while the material progresses through the inner- and intermediate-ducts 15 and 16. A maximum drying or dehydration of the product then takes place.

The drying environment within the ducts is primarily fixed by the B.t.u.'s furnished by the heater and the velocity of the airstream flowing counter to the progression of the material to be dried through the dryer.

Ideally, the temperature and air circulation are always regulated that the amount of heat applied is exactly in proportion to the amount of moisture contained in and removed from the product so that case hardening of the particles of the product can be avoided. The thermostat 56 located in the manifold 55 controls the amount of heat applied.

The dryer is rotated by four motor driven rollers 34 (motor not shown) engaged to run on a roller guide 38. These can be mechanically interlinked in any conventional manner provided the four rollers operate in synchronism. As the consequence of the dryer rotation and the need to air seal the fore end of the dryer, the lip seals 57 are used, particularly to seal the heat-exchange-system and the drying system from each other and from the outside atmosphere.

Additionally, to control the air circulating within the dryer and eliminate influence of outside air, an atmosphere damper 58 is situated in the dryer intake 13 in such fashion that the same is normally in a closed position except for the admission of material to the dryer. Also, an air lock 34 is placed across the discharge spout 35 for the same purpose. The air lock is only opened when material is pushed from the dryer by the flexible peddler 26.

Although a preferred embodiment of this invention has been illustrated and described, it will be understood that other embodiments may exist and that various changes made, particularly in the movement of material through the dryer, the application of inducing a counter circulatory air flow and in heating without departing from the spirit and scope of the invention.

WHAT IS CLAIMED:

1. A rotary drum dryer comprised of a plurality of concentric cylinders mounted for rotation about a horizontal axis defining, a central chamber and a plurality of concentric ducts; the first and second duct, immediately radially outward of the said central chamber, are connected to communicate with each other and in turn connected to communicate in sequential order with the fourth radially outward duct; the said central chamber is connected to communicate with the third radially outward duct; paths of communication established are separate and distinct from each other, a first and second stack means; the said first stack means is connected across the input of the said first duct and the input to the said central chamber thereby afford a selective communication by the input of the said first duct means either with the outside or with the input to the said central chamber; the said second stack means is connected to the unattached end of the said third duct to continue the communication of the said central chamber with the outside, a burner means is mounted in the said central chamber, a first and second blower means; the first blower means mounted in the said first stack means to pull air through the said first, second and fourth ducts in reverse sequential order and to push the air pulled either outside or into the said central chamber as determined by the first stack means; the said second blower means connected in the said second stack means to pull air from the said central chamber through the said third duct and push the air pulled outside, a conveyor means mounted to introduce material to the input end of the said first duct, a recycle auger means mounted to return material from the output of the said fourth duct to the said conveyor means, a material movement means consisting of a deflecting and lifting means attached to the inner walls of each of the said first, second and fourth ducts which in combination with the unified rotation of the said ducts moves material a plurality of passes back and forth the length of the dryer, wherein the evaporation of moisture of the material progressing through the dryer is absorbed by the counter circulating airstream directly proportioned to the amount of heat applied.

2. The apparatus set forth in claim 1 wherein the connection of the said second stack means and the said third duct consists of a plurality of tubes symmetrically spaced within the hollow circular cross section of the said third duct.

3. An apparatus for drying and pulverizing material having a rotary drum housing; a central chamber and a plurality of ducts in telescope relationship within the said rotary housing; a first communication means comprised of the central chamber connected to communicate with the third radially outward displaced duct and a second communication means comprised of the first, second and fourth radially outward displaced ducts connected in sequential communication; the said first communication means connecting to a burner means firing into the central chamber and connected at the opposite end to a stack for exhausting into the atmosphere; the said second communication means adapted to move material laterally back and forth the length of the apparatus upon rotation of the rotary drum housing; a material feeding means connected to the unattached end of the said first duct and a screening means covering the extreme portion of the said fourth duct, an air circulating means for pulling air through the said second communications means in opposition to product travel and a selective exhaust communicating with the said first duct to dispel the pulled air into the atmosphere or circulate the pulled air to circulate in the said first communication means wherein the rate of evaporation of moisture from the heated material is automatically counterbalanced by the moisture absorption capability of the heated air.

4. The apparatus set forth in claim 3 wherein the screening means establishes the size of particles discharged from the apparatus.

5. An apparatus for drying and dehydrating bulk material comprising, a two pass heat exchange system comprising a first heat pass consisting of a cylinder having a heat source at its closed end and a second heat pass consisting of a hollow cylinder concentric with and containing the said cylinder and connected to effect a communication between the open end of the said cylinder and the atmosphere, a heated air circulation means for inducing the heat from the said source to radiate the length of the said first heat pass and after an umbrella like deflection at the point of communication radiate in full cross section and in the reverse direction the length of the said second heat pass and thereafter expelling the heated air into the atmosphere, a three pass drying system consisting of a plurality of concentric circular hollow cylinders having as a first drying pass, the inner or first concentric circular hollow cylinder with an input end for receiving bulk material, adjacent to the said heat source, and said input end also in selective communication with either the atmosphere or the said two pass heat exchange system; as a second drying pass, the second concentric circular hollow cylinder communicating with the other end of the first drying pass: and, a third drying pass, the outer or fourth concentric circular hollow cylinder communicating with the other end of the said second drying pass and at its free end terminating in a discharge chute and communicating with the atmosphere about a section of the peripheral surface in alignment with the said discharge chute, the said two pass heat exchange system and the said three pass drying system being in operative connection to rotate in unison, a plurality of means fixed within the said first, second and third pass of the said three pass drying system to coact with the rotation of the said systems to move material the length of the said first drying pass, in the reverse direction in the said second drying pass and again in the initial direction in the said third drying pass and thereafter to exit through the said discharge chute, an air circulating means to pull an airstream into the third drying pass through the terminal peripheral surface to flow consecutively through the second and then first drying passes and at the terminus of the said first drying pass to be selectively expelled into the atmosphere or introduced into the said two pass heat exchange system, wherein the incoming material traveling through the said first and second drying passes is progressively heated by the contained uniformly high temperature gradient and is aerated by a counter flowing airstream with a progressively increasing moisture absorption capability induced by the said same uniformly high temperature gradient and upon travel through the third drying pass is cooled by the incoming airstream.

6. The apparatus set forth in claim 5 wherein the airstream, after traveling through the said first drying pass, can be selectively expelled into the atmosphere or introduced into the said two pass heat exchange system.

7. The apparatus set forth in claim 3 wherein the pulled air is circulated in the said first communication means before expulsion into the atmosphere.

* * * * *